12/1/87 XR 4,710,778

United States Patent [19]

Radov

[11] Patent Number: 4,710,778

[45] Date of Patent: Dec. 1, 1987

[54] SATELLITE EARTH STATION

[76] Inventor: Mitchell C. Radov, 631 Montroyale Dr. East, Erie, Pa. 16504

[21] Appl. No.: 763,195

[22] Filed: Aug. 7, 1985

[51] Int. Cl.[4] ..... H01Q 3/02; H01Q 1/42

[52] U.S. Cl. ..... 343/882; 343/720; 343/872

[58] Field of Search ..... 343/880, 882, 878, 904, 343/890, 872, 720, 713, 714; 52/200; 126/438

[56] References Cited

U.S. PATENT DOCUMENTS

| | | | |
|---|---|---|---|
| 2,410,666 | 11/1946 | Leck | 250/11 |
| 2,475,746 | 7/1949 | Kenyon | 343/882 |
| 2,712,603 | 7/1955 | Bridges et al. | 343/872 |
| 2,762,041 | 9/1956 | Dyke | 343/100 |
| 2,814,038 | 11/1957 | Miller | 343/757 |
| 2,845,620 | 7/1958 | Hammond, Jr. et al. | 343/11 |
| 2,883,665 | 4/1959 | Maratzke et al. | 343/872 |
| 2,907,031 | 9/1959 | Meredith | 343/757 |
| 2,994,870 | 8/1961 | Anderson | 343/100 |
| 3,059,889 | 10/1962 | Pottmeyer | 248/183 |
| 3,202,015 | 8/1965 | Moul, Jr. et al. | 74/665 |
| 3,375,523 | 3/1968 | Laibson | 343/765 |
| 3,427,626 | 2/1969 | Losee | 343/872 |
| 3,714,660 | 1/1973 | Scrafford et al. | 343/757 |
| 4,197,548 | 4/1980 | Smith et al. | 343/765 |
| 4,295,143 | 10/1981 | Winegard et al. | 343/840 |
| 4,312,002 | 1/1982 | Stewart | 343/872 |
| 4,340,031 | 7/1982 | Niedermeyer | 126/438 |
| 4,360,182 | 11/1982 | Titus | 248/371 |
| 4,379,297 | 4/1983 | Chevallier | 343/882 |
| 4,421,097 | 12/1983 | Meckler | 52/200 |
| 4,490,726 | 12/1984 | Weir | 343/840 |
| 4,583,815 | 4/1986 | Taga et al. | 350/1.6 |

FOREIGN PATENT DOCUMENTS

| | | | |
|---|---|---|---|
| 3125593 | 5/1983 | Fed. Rep. of Germany | 343/878 |
| 0130604 | 8/1983 | Japan | 343/880 |
| 2120856 | 12/1983 | United Kingdom | 343/882 |

*Primary Examiner*—Charles Frankfort
*Assistant Examiner*—Thomas B. Will
*Attorney, Agent, or Firm*—Howson and Howson

[57] ABSTRACT

A modular earth station for communicating with a satellite comprises a frame which is adapted to be installed in an inclined roof for adjustably mounting therein a concave antenna covered by a rigid canopy.

15 Claims, 6 Drawing Figures

FIG. 3
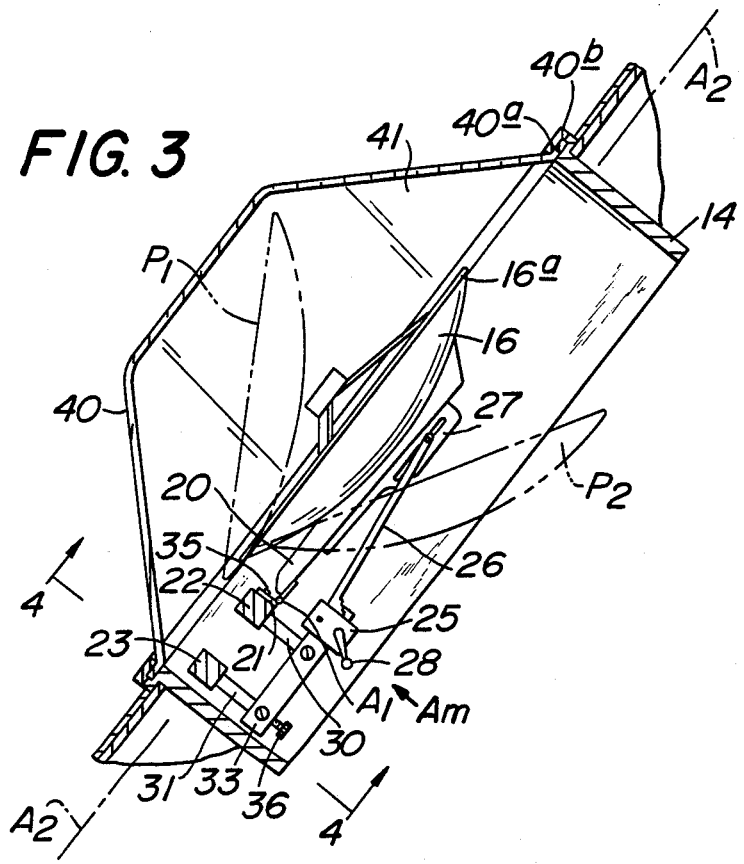
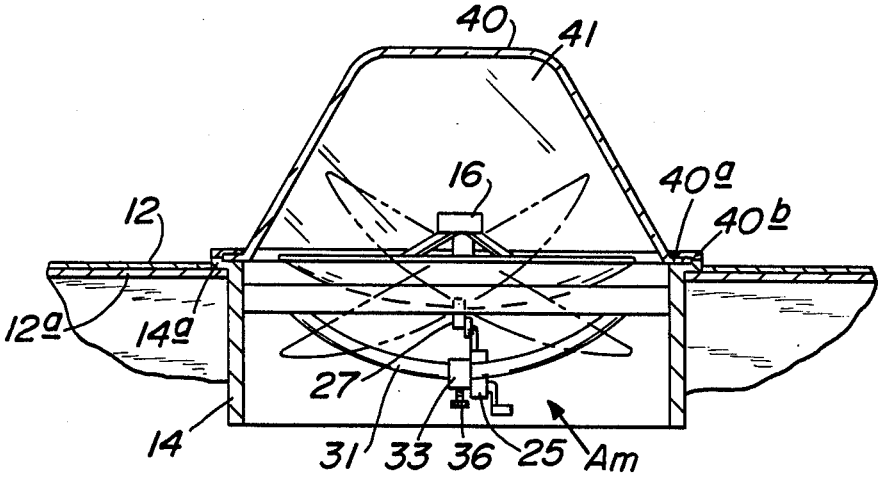
FIG. 4

SATELLITE EARTH STATION

FIELD OF THE INVENTION

The present invention relates to satellite earth stations, and more particularly, the present invention relates to modular satellite earth stations having adjustable antennas.

BACKGROUND OF THE INVENTION

In recent years, there has been an increased demand for microwave antennas capable of receiving direct broadcast signals (DBS) from satellites in stationary earth orbit. Currently, it is necessary for such antennas to be about eight feet in diameter for receiving relatively low power signals in the four to six gigaHertz (C-Band) frequency range. Conventionally, such antennas are exposed and adjustably mounted on posts, tripods or other supporting structures, often in the backyard of a home.

Because of their size and construction, currently available antennas present an unsightly appearance. As a result, many communites have enacted zoning ordinances prohibiting or restricting their installation. Unfortunately, the transmission of signals in the aforementioned frequency band requires relatively large antennas, and this, in turn, requires relatively large supporting framework in order to enable the antenna to withstand imposed wind loads.

In recent years, some success has been realized in transmitting signals at a frequency of twelve gigaHertz in the Ku Band from satellites in geosynchronous, or stationary earth, orbit. The higher transmission frequency enables signals to be transmitted at higher wattage, and this, in turn, permits the signals to be received by smaller antennas. For example, such signals can be received by antennas having a diameter of as small as 1.2 meters.

OBJECTS OF THE INVENTION

With the foregoing in mind, a primary object of the present invention is to provide a novel satellite earth station which overcomes the aesthetic problems associated with known earth stations.

Another object of the present invention is to provide an improved earth station designed specifically to blend into existing architectural structures in an aesthetically pleasing manner.

A further object of the present invention is to provide a unique earth station which is capable of being adjusted readily to receive signals from satellites in stationary earth orbit.

A further object of the present invention is to provide a modular earth station capable of being installed readily in existing structures by persons having a minimum of special skills and tools.

As a still further object, the present invention provides an aesthetically pleasing, durable and economical earth station particularly suited for receiving satellite signals in the Ku frequency range.

SUMMARY OF THE INVENTION

More specifically, the present invention provides an earth station for use in communicating with a satellite in geosynchronous orbit. The earth station comprises frame means adapted to be fixedly mounted in the roof of a building to provide an opening for receiving a concave antenna capable of communicating with the satellite. A means is provided within the frame to mount the antenna for adjustable movement about at least a horizontal axis, and preferably also about an inclined axis parallel to the roof. A canopy means overlies the frame to close the opening and to provide a space for receiving the antenna in selected adjusted positions. Antenna adjustment can be effected manually by a crank operated adjusted mechanism; or it may be effected by electrically powered means actuated from a remote location.

BRIEF DESCRIPTION OF THE DRAWINGS

The foregoing and other objects, features and advantages of the present invention should become apparent from the following description when taken in conjunction with the accompanying drawings, in which:

FIG. 3 is an enlarged longitudinal sectional view taken on line 3—3 of FIG. 2;

FIG. 4 is a transverse sectional view taken on line 4—4 of FIG. 3;

DESCRIPTION OF THE PREFERRED EMBODIMENTS

Figure 1:
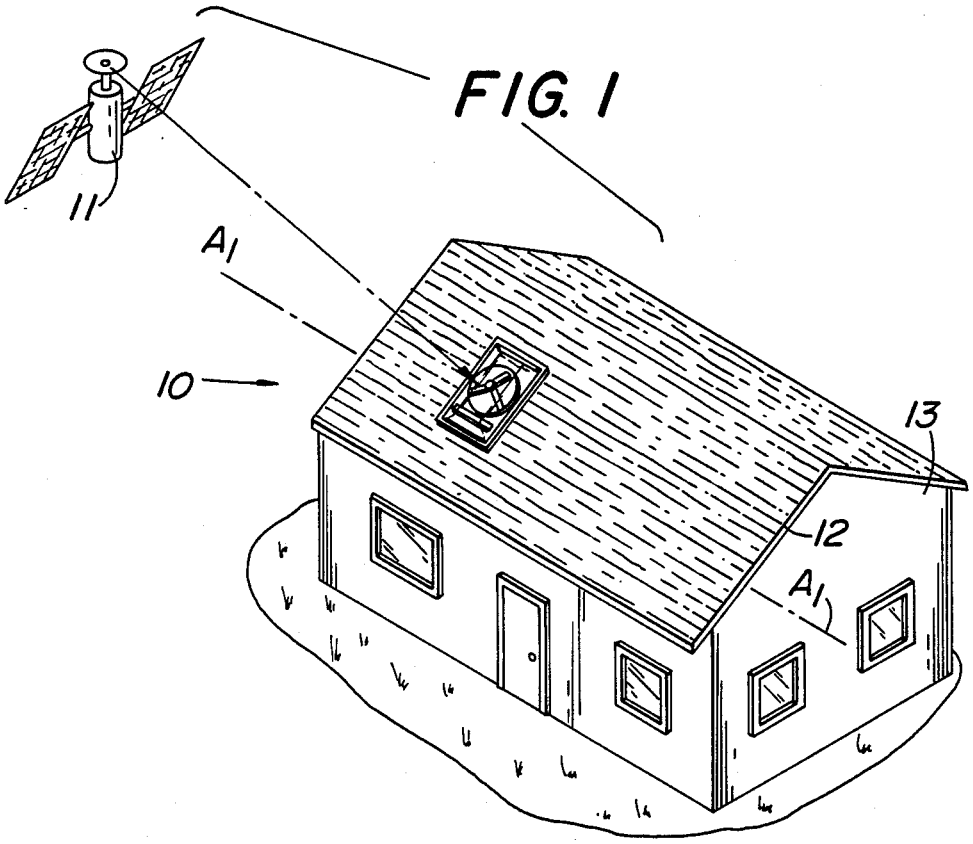
FIG. 1 is a perspective view somewhat schematically illustrating a satellite earth station embodying the present invention for receiving signals from a satellite in geosynchronous orbit.

Referring now to the drawings, FIG. 1 illustrates an earth station 10 which embodies the present invention. The earth station 10 is shown somewhat schematically communicating with a satellite 11 in stationary earth orbit at an altitude of about 22,000 miles above the surface of the earth. In the illustrated embodiment, the earth station 10 is shown receiving signals; however, it should be understood that the earth station 10 may act as an uplink to the satellite 11 for transmitting information or data to other earth stations via the satellite. Accordingly, the present invention should not be regarded as being limited to an earth station capable of only receiving signals.

To communicate with the satellite 11, the earth station 10 must be pointed toward the satellite. In the embodiment illustrated in FIG. 1, the earth station 10 is provided in an inclined house roof 12 which has a southern exposure, i.e. it faces generally in the southern direction when the house 13 is located in the northern hemisphere. In other words, a horizontal line $A_1$ through the roof 12 would be parallel to the equator if the roof 12 had a true southern exposure. In such event, signals transmitted from the satellite 11 in geosynchronous orbit above the equator would impinge upon the roof 12 at a particular angle of incidence, depending upon the satellite location, the latitude of the house 13 in the northern hemisphere, the angle of inclination of the roof 12, and the deviation of the roof from a true southern exposure.

Figure 2:
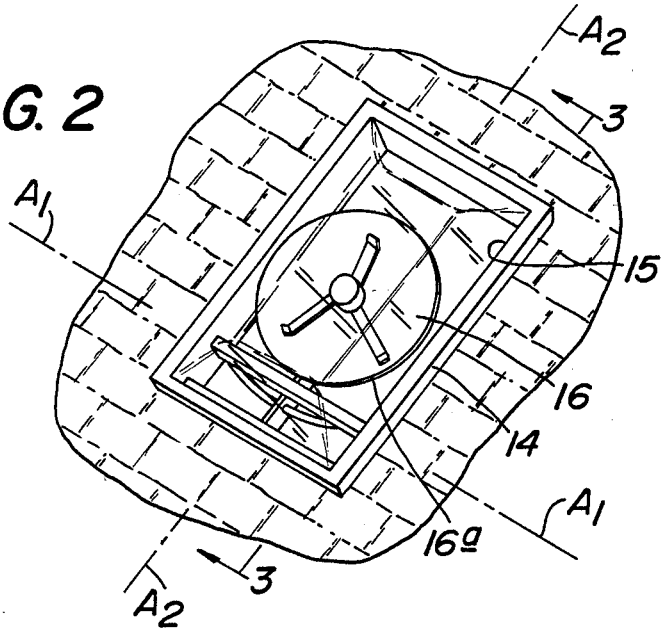
FIG. 2 is an enlarged fragmentary perspective view of the ground station illustrated in FIG. 1.

The earth station 10 accommodates all of the aforementioned variables in an aesthetically pleasing manner. To this end, as best seen in FIG. 2, the earth station 10 is of modular construction and comprises a rectangular frame 14 which defines an opening 15 in the roof 12 for receiving an antenna 16 of conventional construction. The antenna 16 is concave and has a circular peripheral rim 16*a* spaced from the inside of the frame 14 to enable the antenna 16 to move relative thereto. In the illustrated embodiment, the frame 14 mounts directly onto the roof 12 in coplanar relation therewith so that the frame 14 is inclined at the same angle of inclination as the roof 12. See FIG. 3.

According to the present invention, the angle of incidence of the signals with respect to the roof 12, is accommodated by mounting means within the frame 14 which enables the angular disposition of the antenna 16 to be adjusted selectively within a predetermined range, such as the 30° uptilt and 30° downtilt range indicated by the phantom line positions $P_1$ and $P_2$ of the antenna 16 in FIG. 3. In its home position, the antenna 16 lies within the confines of the frame 15 and is disposed substantially coplanar with the roof 12 as indicated in full lines in FIG. 3.

The antenna 16 is capable of being pivoted with respect to the horizontal axis $A_1$ extending lengthwise of the roof 12 in FIG. 1. For this purpose, the underside of the antenna 16 is provided with a diametrically extending support arm 20 connected at its lower end (left-hand end in FIG. 3) to a hinge 21 mounted onto the upper one of a pair of support members 22, 23 extending transversely across the frame 14 adjacent to its lower end. This location of the hinge 21 causes the horizontal axis $A_1$ to be disposed substantially tangential to the lower end of the antenna 16 and adjacent to its periphery.

For the purpose of pivoting the antenna 16 about the hinge 21, and hence the axis $A_1$, an adjusting mechanism $A_m$ is provided. In the embodiment of FIGS. 3 and 4, the adjusting mechanism is manually operated and includes a gear box 25 connected by means of an elongated pivotal arm 26 to a slide assembly 27 located at the upper end of the antenna support arm 20 at about the center of the antenna 16. The adjusting mechanism gear box 25 has a handle 28 which, when rotated in one direction, pivots the arm 26 counterclockwise for tilting the antenna 16 upwardly, and which, when rotated in the opposite direction, pivots the arm 26 clockwise for tilting the antenna 16 downwardly. The gear box 25 and arm 26 are preferably of the type utilized in conventional casement windows for opening and closing the same.

In order to accommodate variations in the exposure of the roof 12, the antenna 16 is also capable of being angularly adjusted with respect to an inclined axis $A_2$ extending parallel to the roof 12 orthogonal to the horizontal axis $A_1$ in a range of 45° east and 45° west. To this end, a means is provided for mounting the manual adjusting mechanism 25 for movement in an arcuate path about the axis $A_2$. As best seen in FIG. 4, this means includes a pair of arcuate rods 30 and 31 extending in spaced parallel relation underneath and along the axis $A_2$ to provide a curved trackway. The rods 30, 31 are mounted at their upper ends to the transverse support members 22 and 23, respectively. A slide block 33 extends transversely across both of the rods 30 and 31 and slidably engages the same so that it is capable of being moved in an arcuate path on the trackway provided by the curved rods 30, 31. Preferably, the manual adjusting mechanism 25 is mounted on the upper end of the slide block 33 so that it moves therewith about the axis $A_2$ when the slide block 33 is moved. Pivotal movement of the antenna 16 about the axis $A_2$ is accommodated by means of a pivot pin 35 which pivotally mounts the hinge 26 to the upper transverse support member 22. The antenna 16 can be releasably locked in any selected adjusted position with respect to the axis $A_2$ by means of a knurled thumbscrew 36 which is threadedly received in the slide block 33 and which engages one of the arcuate rods, such as the lower rod 31. Thus, the antenna 16 can be moved into a selected one of several positions between the limit positions indicated in phantom lines in FIG. 4 and locked in place.

The antenna 16 is protected from damage caused by the elements. To this end, an angular convex canopy 40 overlies the frame 14 and closes the opening 15 therein. The canopy 40 projects upwardly from the frame 14 and provides a space 41 above the roof 12 for accommodating at least a portion of the periphery of the antenna 16 when displaced into an upwardly adjusted position with respect thereto. See the phantom line position $P_1$ of the antenna in FIG. 3. In the illustrated embodiment, the canopy 40 has a peripheral flange 40*a* which is securely fastened to the periphery of the frame 14 as by a cap 40*b*. The canopy 40 is preferably vacuum formed of strong lightweight plastic capable of transmitting high frequency microwave signals with a minimum of interference. While the plastic is preferably clear, it may be opaque and of a color to match the color of the roof 12.

The ground station 10 can be installed readily. To this end, the frame 14 has an outturned peripheral lip 14*a* which is adapted to engage the topside of the roof sheathing 12*a* around a hole cut in the roof 12. The lip 14*a* may be nailed or otherwise fastened to the roof sheathing 12*a*, and the joint is suitably caulked or sealed to provide a permanent leakproof installation. Preferably, the frame 14 is fabricated of deep frame members which are rigidly interconnected to enhance the flexural stiffness of the assembly, particularly in the lengthwise direction.

After the modular ground station 10 has been installed in the manner described, the angle of the antenna 16 is adjusted about the horizontal axis $A_1$ by turning the adjusting mechanism crank 28 in one direction or the other, depending upon the factors noted heretofore. In addition, the antenna 16 is adjusted about the inclined axis $A_2$ by loosening the thumbscrew 36 and sliding the slide block 33 on the curved rods 30 and 31 until the desired adjusted position is reached, whereupon the thumbscrew 36 is tightened. Preferably, the antenna 16 is connected by wires (not shown) to suitable electronic equipment which aids in the adjustment process.

The aforedescribed embodiment of FIGS. 3–4 is designed primarily to communicate with a single satellite in geosynchronous orbit. Thus, with such embodiment, frequent adjustment is not contemplated. With the advent of higher frequency signal transmission, and a demand for greater selectivity among satellites it is anticipated that a series of satellites will be placed in geosynchronous orbit at a predetermined small angle (such as 2°) with respect to the earth's center. In order to enable signals to be transmitted to and received readily from one or more satellites in the series, a modified embodiment of the present invention, which permits remote adjustment of the angular disposition of the antenna, is provided.

Figure 5:
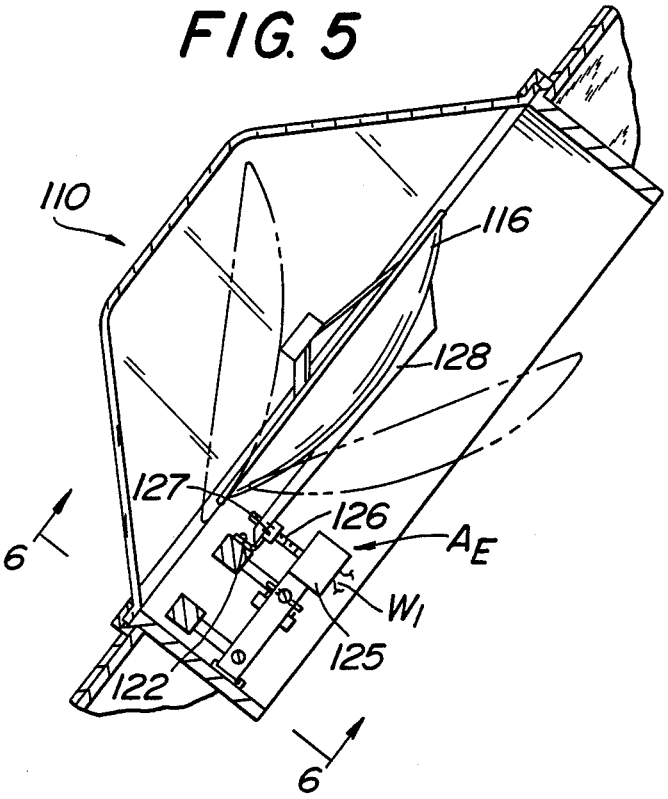
FIG. 5 is a view similar to FIG. 3 but illustrating a modified embodiment of the present invention.
Figure 6:
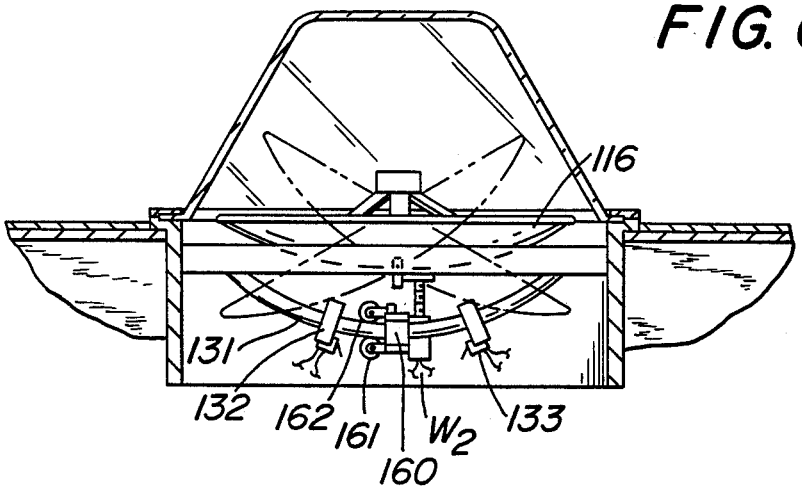
FIG. 6 is a transverse sectional view taken on line 6—6 of FIG. 5.

To this end, as best seen in FIGS. 5 and 6, the modified embodiment 110 is essentially the same in all respects as the embodiment of FIGS. 3–4 except that in place of the manual adjusting mechanism $A_m$, a first electrically actuated adjusting mechanism $A_E$ is provided to adjust the angle of tilt of the antenna 16 about the horizontal axis $A_1$. In the illustrated embodiment, the electrically actuated adjusting mechanism includes a reversible electric motor 125 connected to a screw 126 which threadedly engages a nut 127 mounted in trunnions provided in a support member 128 mounted to the underside of the antenna 116. Preferably, the nut 127 is located close to the hinge 122 so that rotation of the screw 126 in one direction causes the antenna 116 to tilt upwardly about the horizontal axis $A_1$, and rotation in the opposite direction causes it to tilt downwardly. Current is supplied to the motor 125 by wires $W_1$ connected to a suitable power source and switching apparatus located remote from the antenna 116.

For the purpose of pivoting the antenna 116 about the inclined roof axis $A_2$, a second electrically actuated motor or actuator 160 is provided and is connected to a remote power source and switching apparatus by wires $W_2$. See FIG. 6. The motor actuator 160 includes a pair of drive wheels 161, 162 which engage opposite sides of one of the arcuate guide rods, such as the rod 131 and which are rotated in one direction or the other by the motor actuator to tilt the antenna 116 about the axis $A_2$. A pair of limit switches 132, 133 are mounted on the guide rod 131 at spaced locations to arrest movement of the motor actuator 160 and hence to limit the angle of adjustment of the antenna 116. The relative locations of the limit switches 132 and 133 can be adjusted as by set screws such as utilized in combination with a slide block 33 of the embodiment illustrated in FIG. 3. Similar limit switches (not shown) may be provided to limit the range of motion of the antenna 116 about the horizontal axis $A_1$.

In view of the foregoing, it should be apparent that the present invention now provides an improved satellite earth station which blends well with conventional architecture and which overcomes the aesthetic problems associated with conventional earth stations. The earth station of the present invention is of modular design so that it is capable of being installed readily by consumers of average skill. In addition, since the antenna is protected by a canopy, the earth station is resistant to damage caused by the elements.

While preferred embodiments of the present invention have been described in detail, various modifications, alterations and changes may be made without departing from the spirit and scope of the present invention as defined in the appended claims.

I claim:

1. A satellite earth station, comprising:

frame means adapted to be fixedly mounted in a building roof for defining an opening therein;

concave dish antenna means having as peripheral rim received within said frame means opening and movable therein;

means carried by said frame means mounting said antenna for adjustable motion in said opening relative to said frame means, said mounting means cooperating with said frame means to dispose said antenna rim substantially coplanar with the roof when the antenna is in a home position; and canopy means overlying said frame means opening and cooperating therewith to define a space above the opening for receiving at least a displaced portion of the antenna means;

whereby the position of the antenna means can be adjusted relative to the roof.

2. A satellite earth station according to claim 1 wherein said canopy means projects upwardly from the frame means above the plane of the roof for accommodating the antenna means in angularly adjusted positions.

3. A satellite earth station according to claim 2 wherein said mounting means connects said antenna means in said frame means for pivotal movement about a horizontal axis.

4. A satellite earth station according to claim 3 wherein said mounting means connects said antenna means in said frame means for pivotal movement about another axis disposed orthogonal to said horizontal axis and parallel to said roof.

5. A satellite earth station according to claim 1 wherein said mounting means includes hinge means for mounting the antenna means for pivotal motion about a horizontal axis, means movable in a concave arcuate path with respect to said hinge means in said frame means, and adjustment means extending between said movable means and said antenna means operable when actuated to pivot said antenna means about said horizontal axis.

6. A satellite earth station according to claim 5 wherein said movable means includes a slide block, a curved trackway slidably receiving said slide block, and means for releasably locating said slide block on said trackway, said adjustment means being connected to said slide block and said trackway being located adjacent to the periphery of said antenna means.

7. A satellite earth station according to claim 6 including a crank mechanism mounted to said slide block, and an arm connecting said crank mechanism to said antenna means and operable in response to rotation of said crank mechanism to pivot said antenna means about said horizontal axis.

8. A satellite earth station according to claim 6 including first electrically actuated means for actuating said adjustment means and second electrically actuated means for advancing said slide block on said trackway.

9. A satellite earth station, comprising:

a frame adapted to be mounted in a planar building roof for defining an opening in a portion thereof;

a concave antenna having a peripheral rim received within said frame opening and adapted to receive signals from a satellite;

means carried by said frame mounting said antenna for adjustable movement relative to said building roof into selected angularly adjusted positions at least one of which is substantially parallel with the building roof; and a canopy mounted to said frame and projecting above said building roof for providing a space into which the antenna can be angularly adjustably received;

whereby the angular position of the antenna may be adjusted with respect to the plane of the roof.

10. A satellite earth station according to claim 9 wherein said frame means is secured substantially coplanar with said roof, and said mounting means is located relative to said frame means to provide for said antenna a home position which is substantially coplanar with the roof.

11. A satellite earth station according to claim 10 wherein said antenna mounting means includes hinge means permitting said antenna to pivot about a horizontal axis.

12. A satellite earth station according to claim 11 wherein said antenna mounting means includes pivot means permitting said antenna to pivot about an axis extending parallel to the roof orthogonal to said horizontal axis.

13. A satellite earth station, comprising:

a building having an inclined roof;

a frame mounted in said roof and defining an opening therein;

a concave antenna disposed within said frame opening for receving signals from a satellite;

means carried by said frame mounting said antenna for movement from a home position disposed substantially parallel to said roof into selected angularly adjusted positions relative to said roof and canopy means mounted on said frame above said antenna for receiving portions thereof displaced upwardly from said home position.

14. A satellite earth station according to claim 13 wherein said antenna has a circular periphery spaced from said frame, said home position is substantially coplanar with the roof, and said mounting means permits the antenna to be adjusted relative to a horizontal axis.

15. A satellite earth station according to claim 13 wherein said frame has a peripheral lip engaging the topside of said roof and fastened thereto, and said mounting means is located adjacent to the periphery of said antenna.

* * * * *